US010311758B2

(12) United States Patent
Becker et al.

(10) Patent No.: US 10,311,758 B2
(45) Date of Patent: Jun. 4, 2019

(54) SELF LAMINATING WRISTBAND

(71) Applicant: CCL Label, Inc., Framingham, MA (US)

(72) Inventors: William Becker, Lockport, NY (US); Mark Fuller, Framingham, MA (US); Nicole Laski, Hamburg, NY (US); Joseph Langan, East Amherst, NY (US); Vince Mastandrea, Framingham, MA (US); Stan Serwon, Framingham, MA (US)

(73) Assignee: CCL Label, Inc., Framingham, MA (US)

( * ) Notice: Subject to any disclaimer, the term of this patent is extended or adjusted under 35 U.S.C. 154(b) by 0 days.

(21) Appl. No.: 15/593,510

(22) Filed: May 12, 2017

(65) Prior Publication Data

US 2018/0151092 A1 May 31, 2018

Related U.S. Application Data

(60) Provisional application No. 62/427,847, filed on Nov. 30, 2016.

(51) Int. Cl.
*G09F 3/00* (2006.01)
*G09F 3/10* (2006.01)
(Continued)

(52) U.S. Cl.
CPC ..... *G09F 3/005* (2013.01); *G09F 3/0289* (2013.01); *G09F 3/10* (2013.01); *B42D 15/0073* (2013.01); *B42P 2241/22* (2013.01); *G09F 2003/023* (2013.01); *G09F 2003/0255* (2013.01); *G09F 2003/0267* (2013.01); *G09F 2003/0269* (2013.01)

(58) Field of Classification Search
CPC ..... G09F 3/005
See application file for complete search history.

(56) References Cited

U.S. PATENT DOCUMENTS 1,989,781 A 2/1935 Sylvester
3,197,899 A * 8/1965 Twentier ..... G09F 3/005 40/633

(Continued)

FOREIGN PATENT DOCUMENTS

| | | |
|---|---|---|
| CA | 949737 | 6/1974 |
| EP | 1704550 | 9/2006 |
| WO | 2010129131 | 11/2010 |

OTHER PUBLICATIONS

Medirex Healthcare Solutions, Supersoft Bands: Best Practice in Positive Patient Identification, Medirex Supersoft Patent Identification Bands Documentation, Jan. 4, 2013, 12 pp., vol. 1.1, www.positivepatient.ca.

(Continued)

*Primary Examiner* — Kristina N Junge
*Assistant Examiner* — Christopher E Veraa
(74) *Attorney, Agent, or Firm* — McDonald Hopkins LLC

(57) ABSTRACT

In one aspect, a self-laminating identification band is provided. The band is formed from the face stock of a form sheet, with a laminating flap that folds over a printed surface. Adhesive is provided along the flap and along at least one end of the band, so as to allow the band to positioned and looped around itself.

9 Claims, 10 Drawing Sheets

(51) Int. Cl.
*B42D 15/00* (2006.01)
*G09F 3/02* (2006.01)

(56) References Cited

U.S. PATENT DOCUMENTS 3,310,459 A 3/1967 Guthrie
3,809,077 A 5/1974 Hansen
3,860,002 A 1/1975 Kolbach
RE29,789 E 10/1978 Kolbach
4,610,915 A 9/1986 Crenshaw et al.
4,636,418 A 1/1987 Kennard et al.
D294,223 S 2/1988 Gollon
4,774,272 A 9/1988 Lamphere et al.
D305,869 S 2/1990 Gollon
4,914,843 A * 4/1990 DeWoskin ..... G09F 3/005 283/75
D322,815 S 12/1991 Gollon
D345,584 S 3/1994 Gollon
5,653,472 A 8/1997 Huddleston
5,799,426 A 9/1998 Peterson
5,933,993 A 8/1999 Riley
6,000,160 A * 12/1999 Riley ..... G09F 3/005 283/109
6,160,618 A 1/2000 Attia et al.
6,067,735 A 5/2000 Kallenberger
6,067,739 A 5/2000 Riley
6,438,881 B1 8/2002 Riley
6,510,634 B1 1/2003 Riley
6,677,022 B2 1/2004 Bobbe et al.
6,748,687 B2 6/2004 Riley
6,836,215 B1 * 12/2004 Laurash ..... G06K 1/12 156/60
D503,197 S 3/2005 Stewart
7,000,951 B2 2/2006 Valenti, Jr.
7,017,293 B2 3/2006 Riley
7,017,294 B2 3/2006 Riley
7,047,682 B2 5/2006 Riley
D524,184 S 7/2006 Watanabe
7,222,448 B2 5/2007 Riley
7,240,446 B2 7/2007 Bekker
7,322,613 B2 1/2008 Penuela et al.
7,325,247 B2 1/2008 Kotani et al.
7,325,347 B2 2/2008 Riley
7,386,949 B2 6/2008 Riley
7,461,473 B2 12/2008 Riley
D584,352 S 1/2009 Ali et al.
7,520,077 B2 * 4/2009 Riley ..... B42D 15/00 283/75
7,534,477 B1 5/2009 Waggoner et al.
D595,348 S 6/2009 Karen
D600,154 S 9/2009 Ali et al.
7,617,771 B2 11/2009 Ogawa
D608,389 S 1/2010 Bishop et al.
7,654,024 B2 2/2010 Riley
D611,984 S 3/2010 Ali et al.
7,743,540 B2 6/2010 McDermott
7,752,794 B2 7/2010 Kerlin
7,763,344 B2 * 7/2010 Riley ..... G09F 3/005 283/75
7,765,728 B1 8/2010 Waggoner
7,779,569 B2 * 8/2010 Riley ..... B42D 15/00 283/75
7,779,570 B2 8/2010 Riley
7,784,209 B2 8/2010 Greer
D624,120 S 9/2010 Marshall
7,794,809 B2 9/2010 Plummer
RE41,822 E 10/2010 Henley
7,810,267 B2 10/2010 Saint et al.
7,818,908 B2 10/2010 Greer
7,828,333 B1 11/2010 Valenti, Jr. et al.
7,854,818 B2 12/2010 Plummer
7,918,045 B2 4/2011 Riley
D638,468 S 5/2011 Taghavi et al.
7,946,065 B2 5/2011 Ali et al.
D640,738 S 6/2011 Jain et al.
8,006,422 B2 8/2011 Riley
8,011,125 B2 9/2011 Riley et al.
D646,333 S 10/2011 Davis
8,074,389 B2 * 12/2011 Greer ..... G09F 3/005 283/75
D653,148 S 1/2012 Bekker
D663,353 S 7/2012 Waltersdorf
D663,780 S 7/2012 Mingo
D703,755 S 4/2014 Joseph
D703,756 S 4/2014 Ennis
D707,296 S 6/2014 Joseph
8,776,417 B2 7/2014 Jain
D734,311 S 7/2015 Takamoto
D755,894 S 5/2016 Taghavi
D762,263 S 7/2016 Canchola
D772,984 S 11/2016 Canchola
D787,598 S 5/2017 Bridget
2002/0032421 A1 3/2002 Scott, Jr. et al.
2003/0089443 A1 5/2003 Ouederni et al.
2004/0011344 A1 1/2004 Rice et al.
2004/0237366 A1 12/2004 Chadwick et al.
2005/0058814 A1 3/2005 Kraft
2005/0136766 A1 6/2005 Tanner et al.
2005/0173083 A1 8/2005 Moyle
2005/0279001 A1 12/2005 Riley
2006/0113788 A1 6/2006 Riley
2006/0218836 A1 10/2006 Riley
2006/0230661 A1 10/2006 Bekker
2006/0236578 A1 10/2006 Saint
2007/0120358 A1 5/2007 Waggoner et al.
2007/0243361 A1 10/2007 Riley
2007/0259163 A1 11/2007 Connolly et al.
2008/0098636 A1 5/2008 Greer
2008/0109937 A1 5/2008 Greer
2008/0156855 A1 7/2008 Sanchez
2008/0309065 A1 12/2008 Ali et al.
2009/0193701 A1 8/2009 Greer
2009/0277061 A1 11/2009 Jain et al.
2009/0286033 A1 11/2009 Taghavi et al.
2010/0253060 A1 10/2010 Riley et al.
2010/0272938 A1 10/2010 Mitchell et al.
2010/0281724 A1 11/2010 Greer et al.
2011/0000113 A1 1/2011 Chadwick
2011/0039052 A1 2/2011 Plummer
2011/0041370 A1 2/2011 Saint et al.
2011/0071370 A1 3/2011 Al-Ali
2011/0146122 A1 6/2011 Ali et al.
2011/0179686 A1 7/2011 Morehouse et al.
2011/0185612 A1 8/2011 Waggoner
2013/0212919 A1 8/2013 Greer
2016/0229211 A1 * 8/2016 Becker ..... A44C 5/0015

OTHER PUBLICATIONS

Laser Band, Features and Assembly Reference, 2 pp., Copyright 2008, LaserBand LLC, www.greatpages.ca.

Zebra Technologies, LaserBand2 Advanced Wristbands, LaserBand2 Advanced Wristbands Data Sheet, P1061918, May 2013, 4 pp., Copyright 2013, ZIH Corp., www.zebra.com.

Zebra Technologies, LaserBand2 Dura Wristbands, LaserBand2 Dura Data Sheet, P1061913, May 2013, 2pp., Copyright 2013, ZIH Corp., www.zebra.com.

Zebra Technologies, LaserBand 2, LaserBand 2 Data Sheet, P1061920, May 2013, 4pp., Copyright 2013, ZIH Corp., www.zebra.com.

Zebra Technologies, LaserBand Original Wristbands, LaserBand Original Data Sheet, P1061932, May 2013, Copyright 2013, 4pp., ZIH Corp., www.zebra.com.

Zebra Technologies, LaserBand Wristband Solutions, LaserBand Wristband Product Portfolio, P1061921, Aug. 2013, 2pp., Copyright 2013, ZIH Corp., www.zebra.com.

Patent Cooperation Treaty (PCT), International Search Report and Written Opinion for Application PCT/US2017/063828 filed Nov. 30, 2017, dated Mar. 16, 2018, International Searching Authority, EP.

* cited by examiner

SELF LAMINATING WRISTBAND

RELATED APPLICATIONS AND FIELD OF THE INVENTION

This application claims priority to, and all benefits of, U.S. Patent Application Ser. No. 62/427,847, filed on Nov. 30, 2016.

The present subject matter relates to form sheets, articles, and materials suitable for use as self-laminating identification products. Specifically, these articles may be employed as wristbands, ankle bands, and/or other looped, adhesively secured items having a printable surface that is selectively laminated after printing and removal from its liner.

BACKGROUND

Many operations rely on disposable, printable strips that may be affixed to people or objects. These strips are provided in an appropriate and sometimes adjustable length. Often, the strips are formed from a multi-layered form sheet having a face sheet of printable stock and a liner sheet to protect any adhesive. Typically, these strips were formed entirely within the face sheet, while the underlying liner is simply discarded.

The shape of the strip formed from the face sheet after it is released from its label sheet is based on a predetermined cutout. For wristbands, the strip is usually an elongated strip, possibly with an enlarged central portion capable of carrying printed information. Adhesive may be selectively applied to one or both ends of the strip on the underside of the face sheet (i.e., the side that is in contact with the liner when the form sheet is first created). In this manner, after the strip is removed from the liner, it can be looped around an object (e.g., the neck, wrist, ankle or other appendage of a human or other animal) and adhesively secured.

As an example, many hospitals and healthcare providers rely on wristbands to prevent medical errors due to patient misidentification. These bands are removed from form sheets and secured around a patient's wrist or ankle, usually after information such as a patient's name, date of birth, identification number, and sometimes even the patient's picture and an assigned barcode, has been printed or affixed to the band (preferably, while the strip is still carried on its label sheet). The use of a form sheet allows the printing to be applied manually or automatically by feeding the label sheet into a conventional printer such as a laser printer, an inkjet printer, a thermal printer, and the like.

Strips formed into wristbands (and other identification articles) should be relatively thin yet sufficiently stable and rigid to undergo automated printing. The label sheet, including its face sheet and liner, must be able to withstand the mechanical and thermal stresses associated with those operations.

Certain identification strips, and especially those intended for use in a setting where the printed information could be intentionally altered or unintentionally marred (e.g., through contact with fluids, as may happen in a hospital setting), require lamination. Generally speaking, these laminating strips rely on a separate, detachable, clear plastic overlay (provided on the form sheet or as a separate item) that is placed over the printed area by the user either before or after the strip is formed into a looped band.

One drawback to this overlay approach is that it requires the user to precisely position the overlay, and a failure to align the overlay with the printed surface of the wristband may leave adhesive from the overlay exposed in a manner that adheres to the person's body. Also, providing the strip and overlay as separate pieces can lead to loss of one of the pieces and/or confusion for the user in how, where, and when to apply them. If the overlay wrinkles when placed to the printed surface, barcoded images may not be able to be scanned, patient information may be unreadable, and/or wrinkles could provide channels for liquids to directly touch the inner ply, thereby damaging or distorting the patient information.

As a result, a further category of self-laminating wristbands have been developed. Self-laminating wristbands have the laminating layer integrally formed with the band itself. This arrangement avoids the possibility of misplacing the laminate layer (either through loss or through improper application to the strip itself).

Such self-laminating wristbands usually require a more highly engineered form sheet. In terms of components, the form sheet includes a face sheet and a liner sheet may be similar, in terms of materials and appearance, to the more simplistic versions described above. However, the form sheets for self-laminating strips tend to rely on more complex perforation and/or die cuts that selectively penetrate one or both of the face and liner sheets, as well as adhesives disposed on either or both of the underside of the face sheet (same as described above) and the top side of the liner sheet. Additionally, variable-strength cutouts (i.e., one cutout may tear away with less force in comparison to another cutout on that same sheet) and/or differing adhesives between the face and liner sheets may be used to allow portions of a strip made from a form sheet to be temporarily or permanently formed from a combination of layers (i.e., the face sheet and the liner sheet).

One example of known, self-laminating wristband is depicted as it would be disposed on a form sheet (viewed from the face sheet side) in FIG. 1. Other variations are described in U.S. Pat. No. 6,000,160. Here, the step-shaped strip 10 is formed almost entirely made from the liner material except for the printable surface 22 and cutout 26, as will be described below. The strip is generally divided into two ends 12, 14 connected by the central portion 20, having a top half of the central portion includes a printable surface 22, with sealing surface 24 immediately adjacent below the printable surface 22. Printable surface 22 is connected on one edge to end 12, while sealing surface 24 connects to end 14 on the opposite edge as shown, thereby imparting a stepped shape to the strip 10.

Sealing surface 24 is transparent and formed from the liner, while printable surface must be opaque or otherwise capable of retaining, and displaying in readable form, printed information. Printable surface 22 retains a portion of the face sheet for printing, although it is carried on and remains adhered to the liner when the strip 10 is removed from the form sheet.

An adhesive material resides on sealing surface 24 on the same outward facing side of strip 10 (i.e., of the top side of the release liner so as to contact the face sheet when the form sheet is fully intact). Thus, once the strip 10 is removed from the form sheet (for example, by pressing down on cutout 26 to release the liner from the face sheet), the adhesive on surface 24 is exposed. Once the entire band 10 is free from the form sheet, surface 24 (and it associated/attached end 14) are folded over surface 22 to laminate the printable surface 22. The fold must be sufficiently straight to ensure ends 12, 14 remain in proper alignment to simplify looping the ends 12, 14.

A separate adhesive patch and optional, removable face sheet cutout 26 are located at the terminal portion of end 14, also on the outward facing side (i.e., the same as the adhesive on surface 24). Cutout 26 protects the adhesive patch until the strip is ready to be looped and used as a wristband, as described below.

In use, the wristband is fed into a printer while on the form sheet, with the information printed on face sheet material of the print area 22. The liner is then separated from the remainder of the face sheet to create the strip 10. Perforations of varying, appropriate strengths are formed in the liner and face sheets to allow the strip 10 to be removed from the form sheet. While the band 10 is formed from the liner—which separates from the base liner sheet, a small portion of face sheet material associated with the printable surface 22 remains attached to the liner material of the strip 10. In the same manner, printed material appears on the strip 10. Removable cutout 26, designed to protect the adhesive also remains affixed at end 14.

As noted above, the entirety of sealing surface 24 and end 14 are then folded along dotted line 28 so that sealing surface 24 completely covers and adheres to printable surface 22, thereby acting as a laminate for the printable surface. Cutout 26 may then be removed, and ends 12, 14 are joined after looping the remainder of the strip around a person's wrist in a manner that has the printed, laminated information facing outward.

While this arrangement provides a laminated identification wristband, it has a number of drawbacks:

- The reliance on the liner sheet to form the wristband limits the materials that may be used, and the stepped shaped of the strip may limit the ability to provide a substantial number of wristbands on a single form sheet.
- The laminated, printed area 22 of strip 10 relies upon the liner sheet and face sheet remaining sufficiently adhered to one another, as well as the adhesive of surface 24 remaining sufficiently adhered to print area 22 after the wristband is formed and laminated. As such, the arrangement relies on a laminated tri-layer retaining its integrity along two separate surfaces, thereby increasing the chance of failure of the adhesive, separation of the layers, wrinkling, and/or a failure of the laminated wristband to fulfill its intended purpose.
- The need to fold the strip 10 along line 28 end may result in a misaligned (i.e., non-linear) wristband that is unsightly in appearance, may be more difficult to use. In some instances, misalignment can create an uneven surface facing the person's wrist that could lead to potential skin irritation and discomfort (i.e., discontinuities facing the skin are created where the ends are joined and also along the edge where end 14 transitions to the end of central body 20) and, in an extreme cases, an inability to properly connect ends 12, 14.
- The folding action required for laminating requires handling the entire strip 10 after it has been separated from the face sheet with the laminating adhesive exposed, giving rise to potential problems in the event of accident contact between the adhesive on surface 24 and the user's skin, other portions of the strip 10, and/or other objects.

Accordingly, a need exists for a printable, self-laminating identification strip and/or wristband carried on form sheet article providing one or more band products which are securely retained in the sheet, yet which can be readily removed when desired. Moreover, it would be particularly desirable to provide such an article, in sheet, roll, or other form, that can withstand the mechanical and thermal stresses of printing, exhibits desirable skin-contacting qualities such as softness, and is relatively inexpensive and easy to make and use.

SUMMARY

The difficulties and drawbacks associated with previously known products and practices are addressed in the present products and methods for sheeted or web based medical articles.

A self-laminating identification band is provided. The band is formed from the face stock of a form sheet, with a laminating flap that folds over a printed surface. Adhesive is provided along the flap and along at least one end of the band, so as to allow the band to positioned and looped around itself. In some embodiments, the liner sheet may form part of the laminating flap.

In one embodiment, the invention may incorporate any combination of the following features:

- a face sheet made from a printable media;
- a liner sheet;
- wherein at least one identification band defined by die cuts or perforations;
- wherein the identification band comprises a printable body positioned between two ends a common lengthwise axis, the body and ends formed from the face sheet and a laminating flap connected to the printable body, the laminating flap formed from the face sheet and the liner sheet;
- wherein the die cuts or perforations are formed in the liner sheet along at least an outer periphery of the laminating flap.
- wherein a plurality of identification bands are defined on the form sheet;
- a layer of adhesive, positioned between the face sheet and the liner sheet, proximate to at least one of the ends;
- a layer of adhesive, positioned between the face sheet and the liner sheet, in an area comprising the laminating flap; and
- wherein the laminating flap is positioned at an orthogonal angle to the axis.

In another embodiment, an identification system incorporates any combination of the following features:

- a face sheet made from a printable media;
- a liner sheet;
- at least one identification band having an outer periphery containing a printable body positioned between two ends, the printable body and ends aligned along a common lengthwise axis and defined by die cuts or perforations formed only in the face sheet; and a laminating flap foldably contiguous with the printable body, the laminating flap defined by the die cuts or perforations formed in the face sheet and the liner sheet;
- wherein the identification band may be detached from the face sheet and the liner sheet along die cuts or perforations on the outer periphery so that the printable body and the two ends comprise face sheet and the laminating flap comprises liner sheet and a removable overlay of face sheet;
- wherein an adhesive patch is disposed on at least one end of the identification band;
- wherein an adhesive patch is disposed on the liner sheet of the laminating flap;

wherein, when the identification band is detached, the printable body and two ends consist of face sheet with an optional adhesive patch disposed on at least one of the ends;

wherein, when the identification band is detached, the two ends consist of face sheet with an optional adhesive patch disposed on at least one of the ends;

wherein a width of the printable body is greater than a width of at least one of the two ends, said width of the printable body and said width of the at least one end measured orthogonally to the lengthwise axis;

wherein the laminating flap folds over the printable body in an orthogonal direction relative to the lengthwise axis after the identification band is detached;

wherein the face sheet and liner sheets are provided as a continuous roll with a plurality of identification bands formed therein; and wherein at least one label defined by a second set of die cuts or perforations is provided in at least one of the face sheet and the liner sheet.

Yet another embodiment contemplates a sheeted article providing at least one identification band, the article having any combination of the following features:

a face layer having an upper surface and a lower surface and defining at least one identification band, the at least one identification band having a first region proximate a first end, a second region defined by a second end, a print region defined between the first and second region and defining a top edge and a bottom edge, and a strap extending between the first and second end;

a liner layer;

a laminating member defined in the liner layer, the laminating member comprising a clear lamination flap proximate to the bottom edge of the print region, the flap comprising an upper surface and a lower surface, the upper surface of the flap having an adhesive disposed thereon, where the flap is detachable from the liner and foldable such that the upper surface of the flap contacts the upper surface of the identification band to cover at least a portion of the print region;

wherein the laminating member comprises a section of the liner underlying the lower surface of the print region, and the laminating member is detachable from the sheeted article when the identification band is removed from the article;

wherein the lower surface of the identification band in the print region is detachable from the liner layer;

wherein the face layer comprises a release layer overlying the upper surface of the laminating flap, the release layer removable from the laminating flap to expose the adhesive;

a release material disposed on the liner layer in an area corresponding to the first region of the band;

a first adhesive overlying the release material;

a second adhesive disposed on the liner extending along at least a majority in an area corresponding to the second region of the band;

a deadener disposed on the second adhesive; wherein upon removal of the identification band from the sheeted article, the first region of the identification band comprises the region of pressure sensitive;

wherein the print region does not include any adhesive disposed on either the upper surface or the lower surface;

wherein a dry peel adhesive, a releasable pressure sensitive adhesive or a combination of adhesives is disposed on at least a portion of the lower surface of the face layer within one or more of: the first region, the first end, the second region, the second end, and the strap;

wherein a plurality of identification bands are provided;

wherein the face layer and the liner layer comprise a combination form sheet; and wherein the combination form sheet includes at least one of a label and an extender.

A method of forming a laminated wristband having printed indicia for identification is also contemplated incorporating any combination of the following features:

providing a form sheet having: i) a face sheet with a printable, outward-facing surface and cuts or perforations defining a printable body proximate to a laminating flap and two looping ends on opposing sides of the central body, and ii) a liner sheet affixed to an inner-facing surface of the face sheet and having a flap portion corresponding to the laminating flap of the face sheet;

printing indicia on the printable body of the face sheet;

removing the laminating flap from the face sheet from the form sheet to expose the flap portion of the liner;

folding the flap portion over the central body to create a laminated side while the central body and looping ends remain part of the form sheet and removing the central body and the looping ends of the face sheet from the form sheet;

affixing the looping ends to form a wristband having the laminated side positioned on an outer facing portion; and wherein the laminating flap is removed from the face sheet after the face sheet is and the flap portion of the liner are removed from the form sheet.

Finally, a wristband made from a face layer is contemplated, the band incorporating any combination of the following features:

two ends disposed on opposing laterally edges of printable body, wherein the ends and the printable body consist and are formed from the face layer;

a laminating flap disposed orthogonally to the printable body, the flap comprising a removable layered structure including a liner layer attached to the face layer;

wherein the face layer is selectively removed to expose a clear laminating flap;

wherein the laminating flap is machined to fold over the printable body;

wherein the laminating flap and the printable body have the same dimensions;

wherein a portion of the liner layer is affixed to a portion of the printable body; and an adhesive disposed on at least one of the ends.

Specific reference is made to the appended claims, drawings, and description below, all of which disclose elements of the invention. While specific embodiments are identified, it will be understood that elements from one described aspect may be combined with those from a separately identified aspect. In the same manner, a person of ordinary skill will have the requisite understanding of common processes, components, and methods, and this description is intended to encompass and disclose such common aspects even if they are not expressly identified herein.

BRIEF DESCRIPTION OF THE DRAWINGS

Operation of the invention may be better understood by reference to the detailed description taken in connection with the following illustrations. These appended drawings form part of this specification, and any written information in the drawings should be treated as part of this disclosure. In the same manner, the relative positioning and relationship of the components as shown in these drawings, as well as their function, shape, dimensions, appearance, and the sequencing of any time-lapsed steps may all further inform certain aspects of the invention as if fully rewritten herein.

DETAILED DESCRIPTION

Reference will now be made in detail to exemplary embodiments of the present invention, examples of which are illustrated in the accompanying drawings. It is to be understood that other embodiments may be utilized and structural and functional changes may be made without departing from the respective scope of the invention. As such, the following description is presented by way of illustration only and should not limit in any way the various alternatives and modifications that may be made to the illustrated embodiments and still be within the spirit and scope of the invention.

As used herein, the words "example" and "exemplary" mean an instance, or illustration. The words "example" or "exemplary" do not indicate a key or preferred aspect or embodiment. The word "or" is intended to be inclusive rather an exclusive, unless context suggests otherwise. As an example, the phrase "A employs B or C," includes any inclusive permutation (e.g., A employs B; A employs C; or A employs both B and C). As another matter, the articles "a" and "an" are generally intended to mean "one or more" unless context suggest otherwise.

Figure 2A:
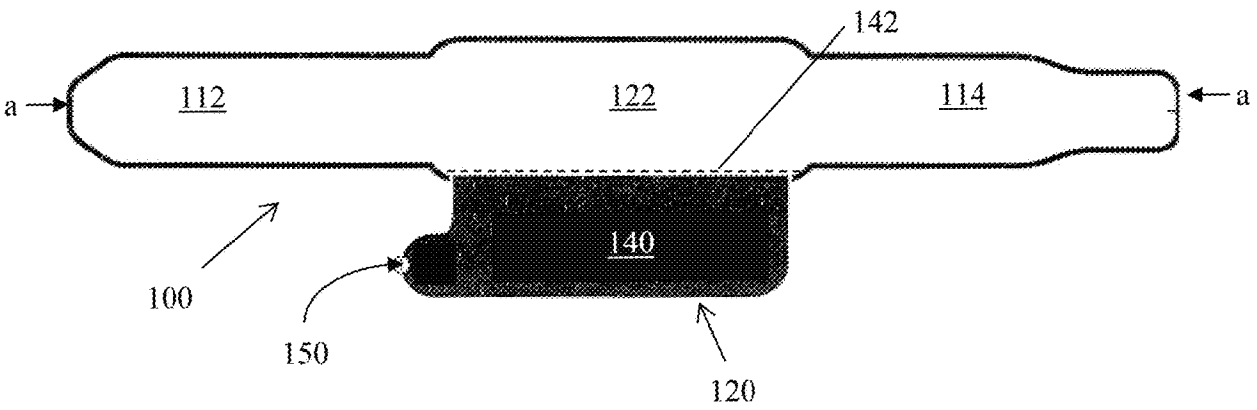
FIGS. 2A and 3A are top views of a form sheet, showing its face sheet side, according to certain disclosed aspects.
Figure 3A:
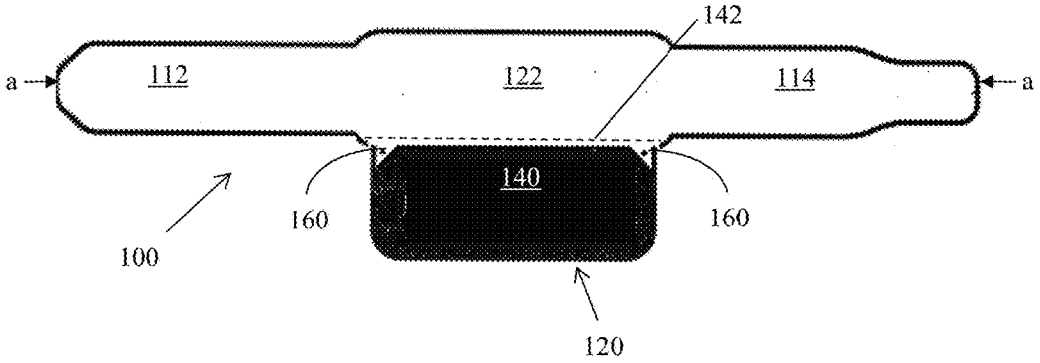

Referring to aspects of the invention shown in FIGS. 2A and 3A, a form sheet having appropriate die cuts or perforations for an identification band 100 is shown. The band 100 has a central portion 120 disposed between opposing ends 112, 114. The central portion 120 includes printable portion 122 and laminating flap 140 attached to portion 120 orthogonally from the opposing ends 112, 114. In both figures, the face sheet will form the outer-facing of the band 100, so that printed indicia may be placed or imprinted anywhere on the face sheet of band 100, although central portion 120 (and, more specifically, central body 122) represents the printable surface area which will be laminated, as described in greater detail below. The central image receiving portion may be offset toward one end or the other of the band and not depart from the scope of the invention. In addition to separating from the liner, the die cuts, perforations and the like are formed in the face sheet and portions of the liner associated with the laminating flap. As such, the die cuts or perforations serve to define the shape of the band 100 in both its removed from the form sheet state and in its final, assembled/laminated state.

Dashed line 142 establishes the boundary between the laminating flap 140 and the central body 122 of the band 100, and cuts or perforations may facilitate folding along that line. A removable cutout of face stock is provided in the flap area 140. Once this cutout is removed, the remaining flap 140 is a clear polymer appendage with an adhesive applied on the now-exposed top. The user then folds this clear plastic flap 140 over central portion 120, thereby covering and laminating central body 120.

In some embodiments, this laminating flap 140 is formed from the liner sheet, with the die cuts allowing this portion of the liner to remain adhered to the face sheet. In effect, both the face sheet and the liner associated with the flap 140 are released when the band 100 is removed from the form sheet, so that the face sheet of the flap 140 becomes a removable cutout that protects the adhesive placed on the liner in the flap area 140.

The liner has adhesive disposed between the liner and the face sheet in flap portion 140. This arrangement affords the user with greater flexibility in deciding when to laminate the printed surface by selectively removing the face sheet over the flap 140 (i.e., possibly before removing the band entirely from the form sheet, after the band is removed from the sheet but prior to its use or even after the band has been looped into place). In some embodiments, the portion of the liner sheet underneath the body 122 may also detach from the form sheet.

The boundary along line 142 may be formed so as to facilitate folding the laminating flap. It may also be possible to form the flap portion 140 from a tri-layer material, with the liner sheet both under the flap 140 and the remaining portions of the band 100 remaining completely intact and part of the discarded portion of the form sheet (i.e., the liner and unused portions of face stock outside of the periphery of the band).

Figure 8A:
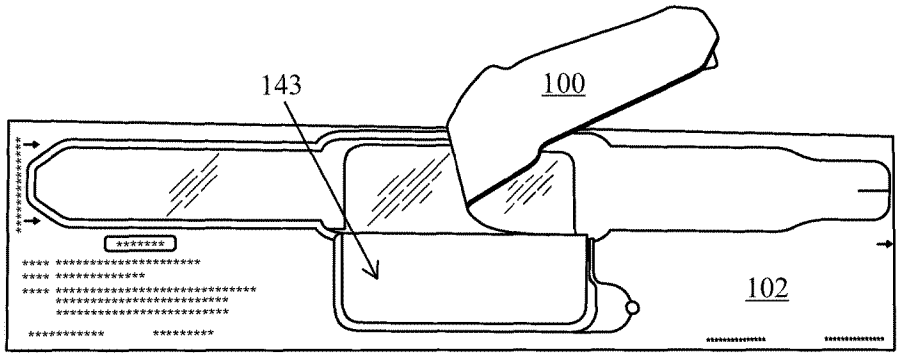
FIGS. 8A and 8B are perspective views showing the portions of the liner sheet that are not removed with the band.
Figure 8B:
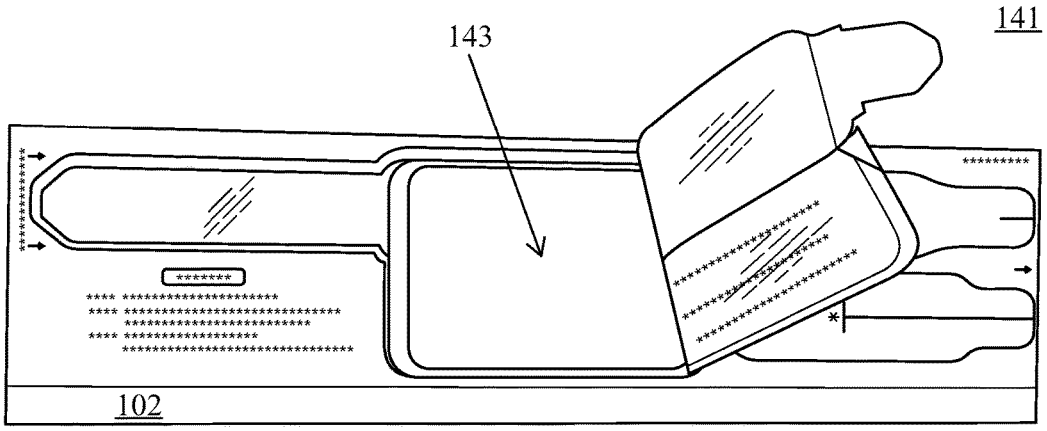

As seen in FIGS. 8A and 8B, it is also possible for a portion of the liner sheet to remain with the unused liner and face sheet as the band 100 is removed from the form sheet. In FIG. 8A (where the lamination step was performed prior to removing the band from the form sheet), the liner beneath the central portion 120 separates from the band 100, with only the portion directly under flap 140 remaining as part of the eventual wristband. In FIG. 8B (where lamination can occur after the band is removed from the form sheet), the entire liner associated with the central portion 120 and flap 140 are taken up as part of the wristband. In a final alternative and as noted below, the face sheet of flap 140 (or even all of the face sheet) may also be of a construction that leaves the entire liner intact and discarded along with the unused portions of the face sheet.

In one embodiment shown in FIG. 2A, a peel tab 150 is provided along an edge of the flap 140. The band 100 may be pre-laminated while still in the liner sheet by pulling tab 150 to remove the cutout portion 151 of the face sheet that covers the flap 140. The flap 140 is may then be folded over the central portion 122 to laminate printed material thereon. In this manner, the remaining band 100 (ends 112, 114 and now-laminated body 122) may then be separated from the liner and form sheets for subsequent looping and creation of a wristband. This approach is effectively the same as the time-lapse progression shown in FIGS. 4A through 4H for the peel-edge embodiments (described below).

Alternatively, the peel tab 150 could be engineered to simply facilitate removal of the band 100 from the form sheet. In this case, the liner sheet associated with flap 140 remains attached to the face sheet portion of flap 140 so that, when the band 100 is removed from the form sheet, face sheet-only portions of ends 112, 114 and body 120 are included, while the flap 140 consists of both liner sheet and face sheet. This approach is shown in the time-lapse progression of FIGS. 6A and 6B. As illustrated therein, a portion of liner sheet 141 associated with both the flap 140 and central body 122 is taken up, as indicated by glossy portion 142 on the band 100. The attachment of portion 142 with the band 100 during and, in some cases, after it is removed from the form sheet creates a void 143 in the unused portions 102 of the form sheet. Although not specifically shown, this approach (of retaining liner sheet under both the central body 120 and flap 140 when the band 100 is removed from the form sheet) may also be used for embodiments relying on peel edges 160.

After the band 100, including the liner sheet portion of flap 140, is removed from the form sheet, tab 150 may then be used to separate and discard the face sheet associated with flap 140. The clear, liner-only portion of flap 140 remains attached to the band and is folded over the body 122, as shown in the time-lapse progression shown in FIGS. 5C through 5E in order to create the laminated band 101.

Sufficient perforations/die cuts allow the other portions of the band 100 to separate from the form sheet and, more specifically, from the unused portions of face sheet 102. Additional scoring, grooves, or thinned portions may facilitate the folding action of the liner sheet flap 140 over the central body 120.

In FIG. 3A, one or more peel edges 160 are provided in place of a peel tab. Here, the edges 160 allow for easy removal of the cutout protecting the laminating flap 140. In this arrangement, the flap is preferably folded over the central body 122 while the remainder of the band is still attached to the form sheet. Once laminated, the user then removes the ends 112, 114 and the remainder of central body 120 from the form sheet (as seen in FIGS. 4B through 4E). However, as with FIG. 2A, it may be possible to first release the band 100, including the flap 140, from the form sheet and then subsequently remove the face sheet along the flap portion 140 to laminate the body 122, as shown and described in FIGS. 5A though 5E. In this manner, the entire band 100 does not need to be handled or manipulated during the lamination step.

One or more adhesive patches are also applied along end 112 and/or 114. In some embodiments, these patches may be applied to the underside of the face sheet so that the adhesive is exposed when the band 100 is released from the form sheet. In other aspects, it may be possible to integrally form removable, protective cutouts as part of a tri-layered face sheet so that the adhesive is protected it until the band 100 is looped/placed into its final position.

Further, in each of FIGS. 2A and 3A, the ends 112, 114 and body 122 are aligned along a common axis defined by line a-a. The flap 140 is positioned at an offset from that axis, immediately proximate (and, preferably, orthogonal to) body 122. This arrangement allows for the laminating flap to be properly aligned, while still providing sufficient surface area on the band 100 for the ends 112, 114 to be affixed to one another to form a loop. Body 122 and flap 140 should have similar, if not identical, shapes so as to facilitate the lamination procedure, and body 122 may be wider than the ends 112, 114 (when measured orthogonally to the common axis) so as to provide a larger surface area for printing.

Figure 2B:
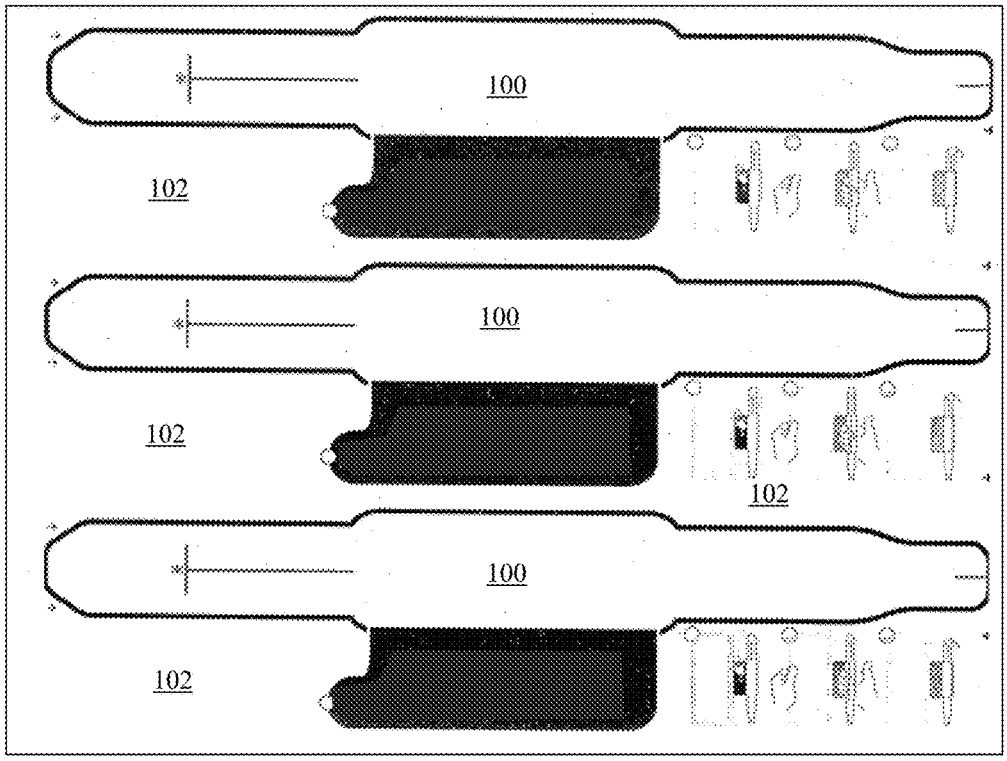
FIGS. 2B and 3B exemplary form sheets corresponding to FIGS. 2A and 3A, respectively speaking.
Figure 3B:
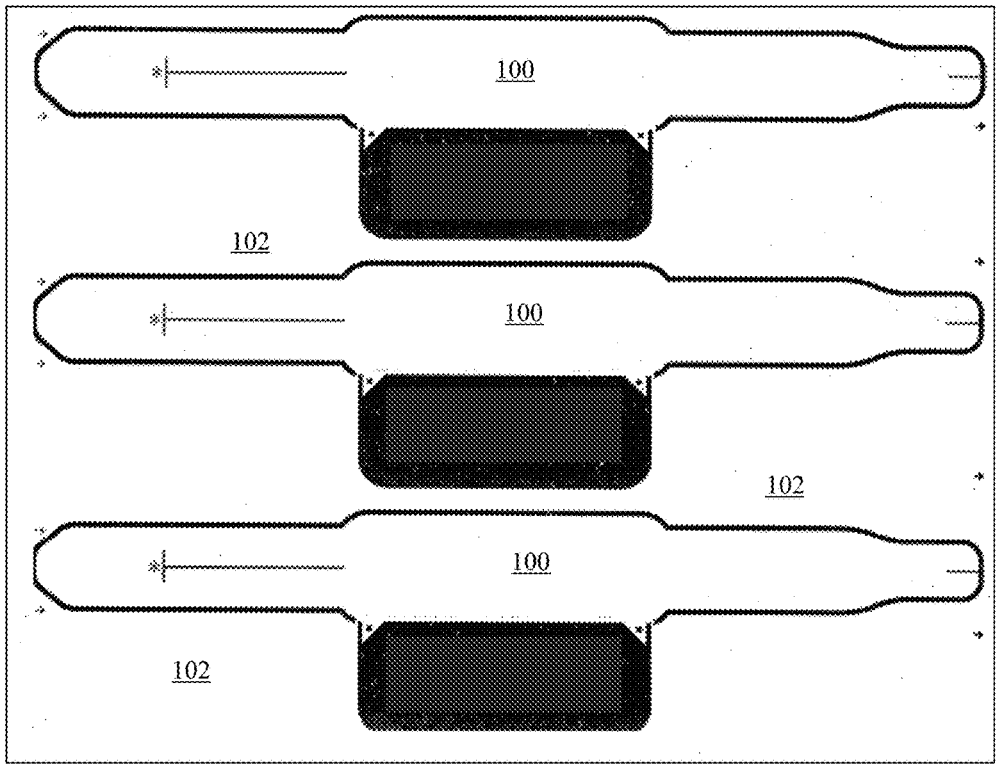

FIGS. 2B and 3B correspond to exemplary form sheets having a plurality of bands arranged on a single sheet. In this manner, multiple identification bands can be printed onto a single form sheet. Perforations or die cuts may be formed between bands to allow for easier handling of individual bands up until the point at which they are to be used. It may also be possible to incorporate user instructions or otherwise allow for other printing and use on the portions of the form sheet (i.e., the unused face sheet and/or the backing layer) that do not become part of the final identification band.

Figure 9:
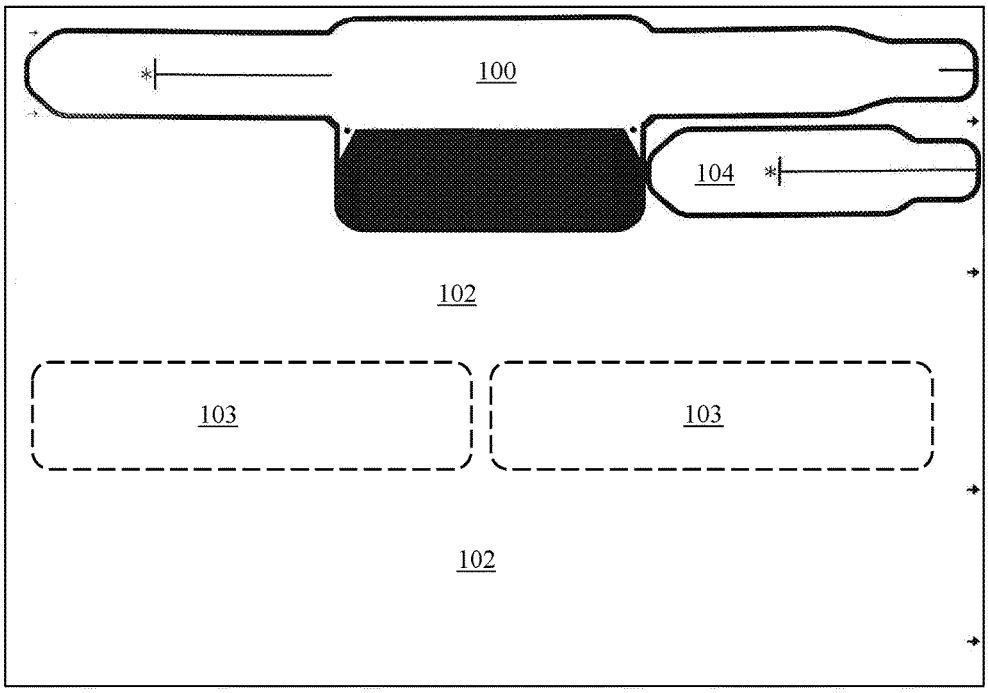
FIG. 9 is a top view of a form sheet including an extension insert.

One or more extender strips 104 may be incorporated into any of the form sheets described herein, with an example illustrated in FIG. 9. Such a strip 104 is merely intended to accommodate situations in which the length between ends 112, 114 of the band 100 is insufficient. Such an extender strip can be provided directly on the form sheet. When provided, it may be formed from the face sheet, with an adhesive patch provided on one edge. If the band 100 is formed with adhesive on both ends, it may not be necessary to provide adhesive to the strip 104. In use, the non-adhesive edge (or edges) is attached to one of the ends 112, 114 with the adhesive portion of the extension attaching to the other of those ends 112, 114 to form the enclosed loop. Generally speaking, when present, one strip 104 per band 100 should be provided in the form sheet, although not every band requires an extender and, conversely, multiple extenders could be used with one band.

Additionally, FIG. 9 is shown as a combination form sheet. In this embodiment, additional articles, such as one or more labels 103, may be formed in the face layer and/or the liner layer. These labels 103 can be used on or in conjunction with band 100, as well as for completely different purposes. Like the bands above, labels 103 are defined by die cuts, perforations, or other means, and the labels 103 are preferably formed in the form sheet in the unused portion 102. Also, while FIG. 9 only shows one identification band 100, it will be understood that such combination form sheets may include a plurality of bands according to any of the embodiments described herein. In the same manner, one or a plurality of labels 103 can be provided. Further, the combination sheets, such as the one in FIG. 9, do not necessarily need to include extender strip 104.

Once removed from the form sheet and looped into place as shown in FIG. 4, the resulting identification band 100 has an outer facing printed surface 122 that is laminated. However, because only the laminating flap is folded, the band presents a more continuous surface in comparison to the arrangement described in FIG. 1A (except, of course, for the portion where the terminal ends 112, 114 are joined together). Also, reliance on the face sheet to form the band provides greater flexibility to incorporate printed material on any portion of the resultant band. Still further, the ability to accomplish the laminating step while the majority of the band 100 is still held on the form sheet should simplify the lamination process for the end user.

A method of forming a wristband according to the uses described above is also contemplated. In addition to the uses described above, the methods are further illustrated in FIGS. 4A through 4H and 5A through 5E. Notably, these figures also serve to inform the apparatus as described above. The time-lapse nature and sequence of these sets of figures further informs this disclosure, and depicted steps are fully disclosed as part of this written specification.

Figure 4A:
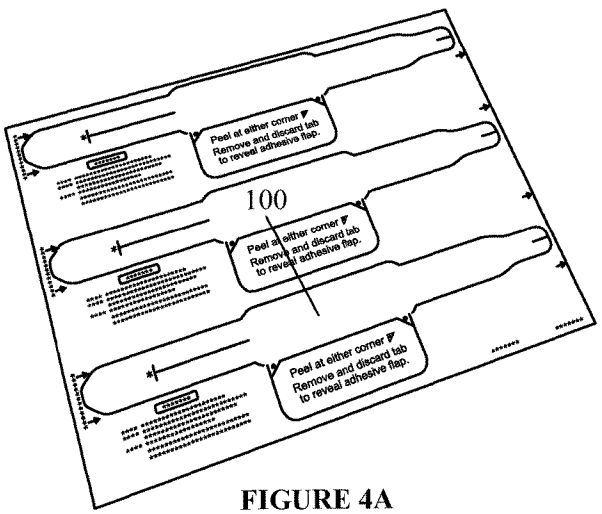
FIGS. 4A through 4H are perspective views showing a time lapsed progression as to how the self-laminating band of FIG. 3B may be laminated while the face sheet of the band is retained on the form sheet.
Figure 4B:
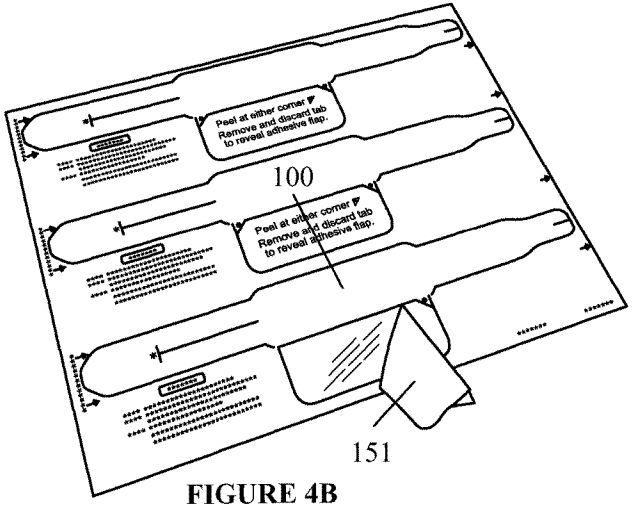
Figure 4C:
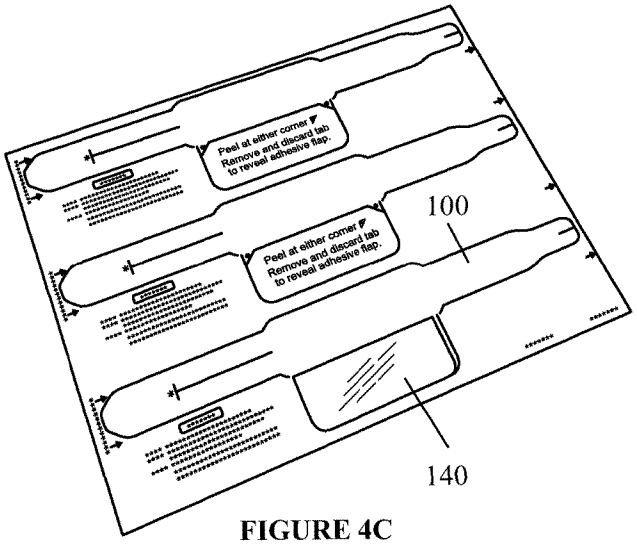
Figure 4D:
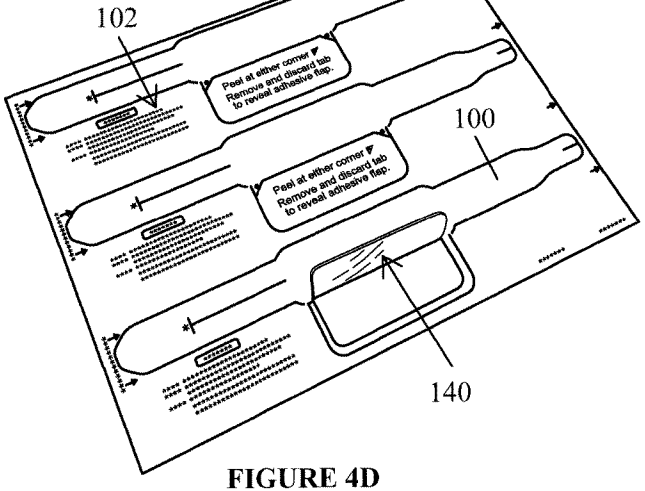
Figure 4F:
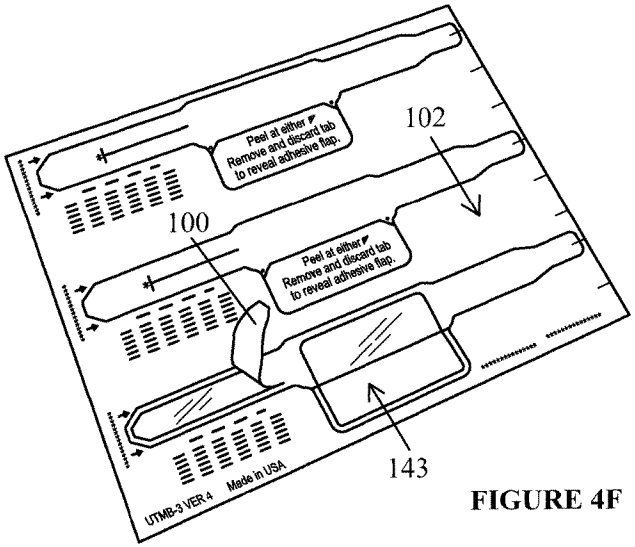
Figure 4H:
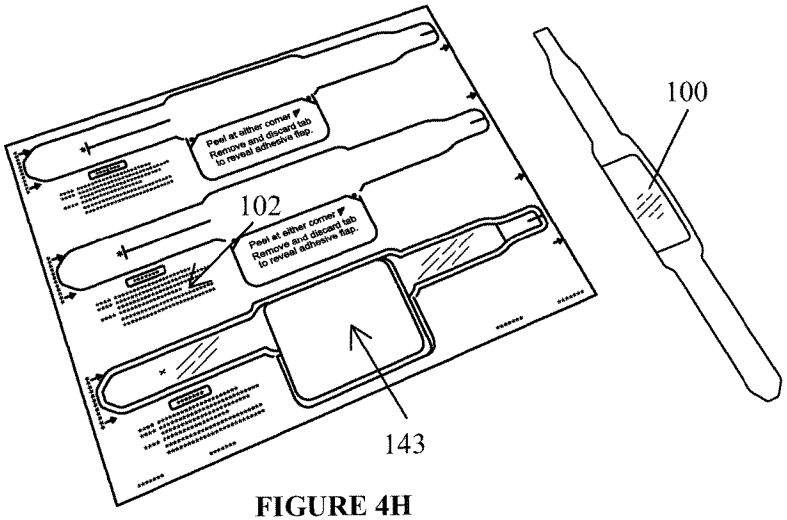
Figure 4E:
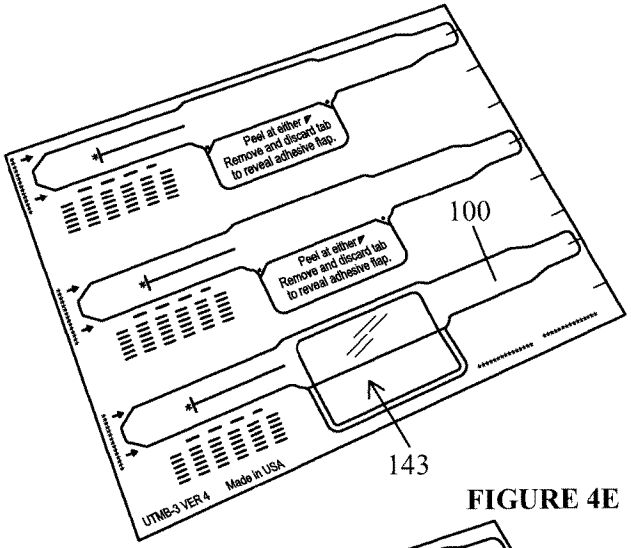
Figure 4G:
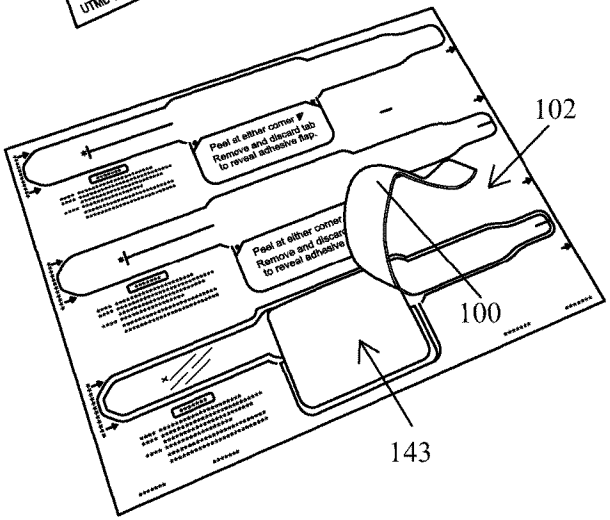

A plurality of bands may be integrated into a single form sheet, as seen in FIG. 4A. The face sheet above the laminating flap is removed as shown in FIGS. 4B and 4C (note: while a peel edge is shown in FIGS. 4B and 4C, it is also possible to use this approach with the pull tab illustrated in FIGS. 2A and 2B), and the clear laminating flap is then folded over the central body positioned immediately above it as seen in FIG. 4D. FIG. 4E shows the band still partially retained in the form sheet, but with the printable area now fully laminated (this illustration is representative whether a pull tab or peel edge is used). FIGS. 4F and 4G show the now-laminated band being fully removed from the form sheet, with FIG. 4H showing the final, laminated band before it is looped and affixed for its final use as an identification band.

Figure 5A:
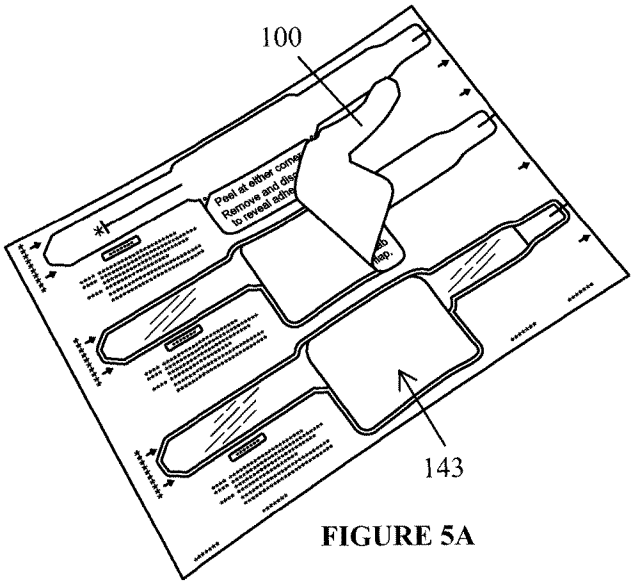
FIGS. 5A through 5E are perspective views showing a time lapsed progression as to how the self-laminating band of FIG. 3B may be laminated after the band has been fully released from the form sheet.
Figure 5B:
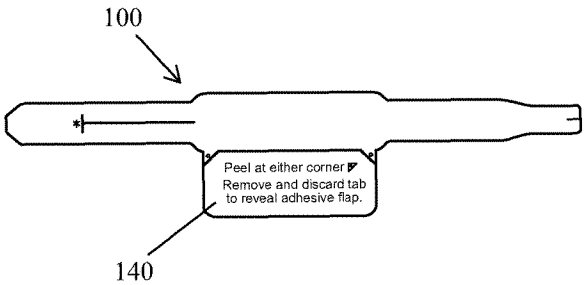
Figure 5C:
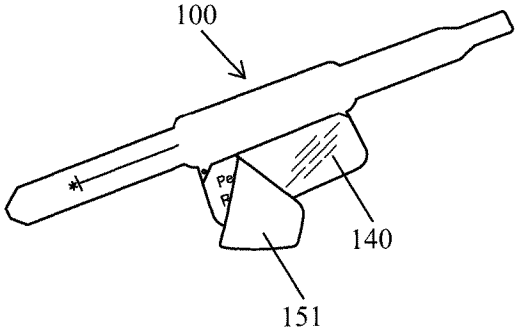
Figure 5D:
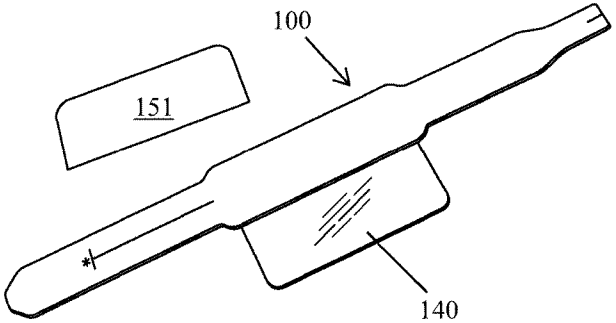
Figure 5E:
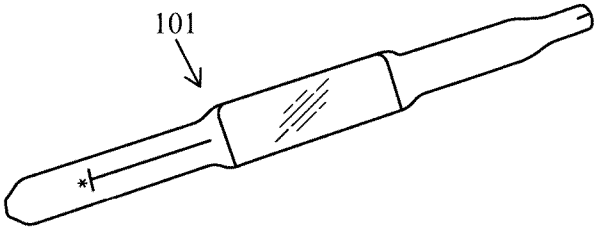
Figure 6B:
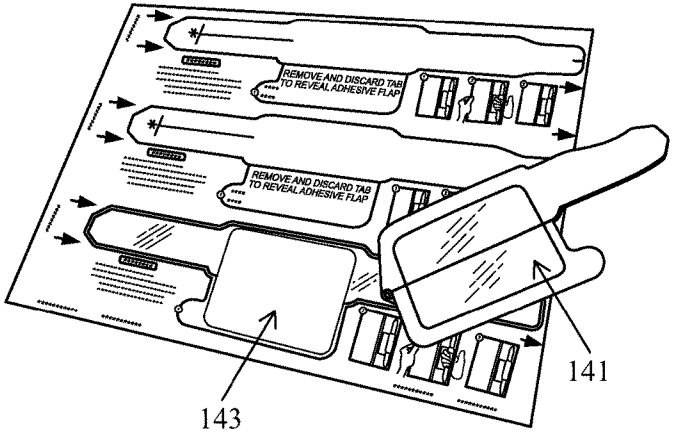
FIGS. 6A and 6B are perspective views showing a time lapsed progression as to how the self-laminating band of FIG. 2B may be removed from the form sheet, with subsequent steps for laminating the band similar to those shown in FIGS. 5C through 5E.
Figure 6A:
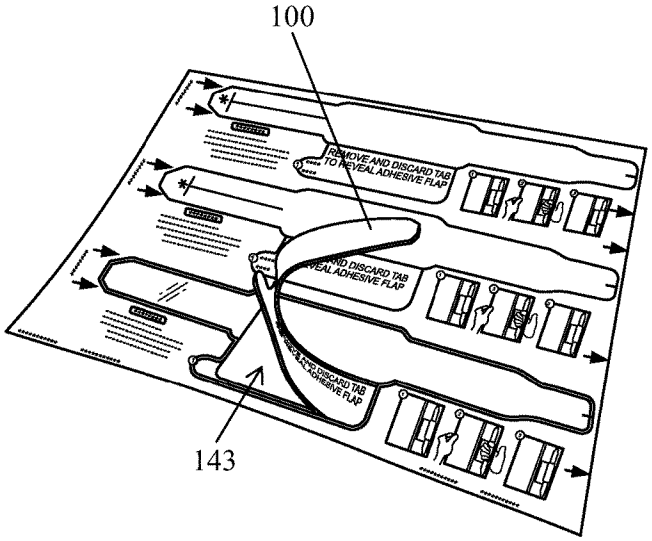

FIGS. 5A through 5E and FIGS. 6A and 6B illustrate an approach to removing the band from the form sheet and then, thereafter, laminating the printable area. Here, FIGS. 5A, 6A, and 6B depict removal of the band and the flap, with the face sheet still adhered to the flap. FIG. 5B show the band and flap as fully removed from the face sheet (note: while FIG. 5B shows a "peel edge," the same result can be attained with a pull tab shown in FIGS. 6A and 6B, and the subsequent actions of FIGS. 5C through 5E are essentially identical). FIG. 5C shows removal of the face sheet from the laminating flap, which is shown as fully exposed in FIG. 5D. Finally, as seen in FIG. 5E, the laminating flap is folded over the printed area on the body, providing an identical band as that seen on the right side of FIG. 4H.

Figure 7B:
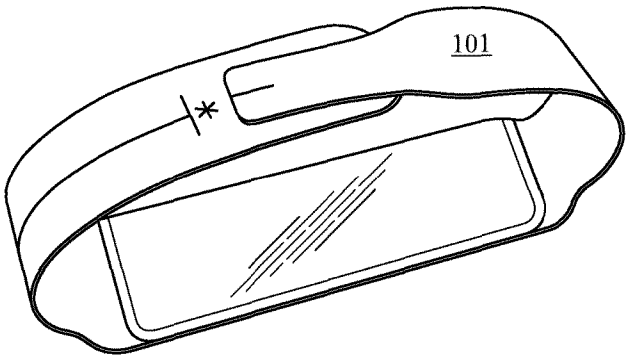
FIGS. 7A and 7B are perspective views of a wristband according to FIG. 2A or 3A in their final, assembled state (i.e., removed from the form sheet and looped into an identification band).
Figure 7A:
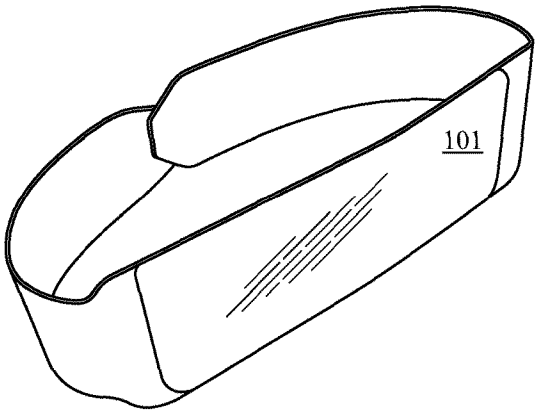

The laminated, removed band is then looped around itself so that the adhesive on the terminal end of the band adheres to the opposing terminal edge, resulting in the wristband or identification bands shown in FIGS. 7A and 7B. With further reference to FIGS. 4A, 5A, and/or 6A, the markings on the bands shown in FIGS. 7A and 7B (e., lines conforming to the direction of the band, lines with hash marks, asterisks, etc.) provide context as to the outward facing side of the final wristband. Specifically, alignment markers can be printed on the outward facing side of the face sheet at one end of the band and on the outward and/or inward facing side of the face sheet at the opposing end of the band. In this manner, the user can quickly and easily align the ends to ensure a straight fit. These markings may also facilitate identifying the location at which the adhesive patch resides (especially in the event a cut out is not covering that patch).

Figure 1:
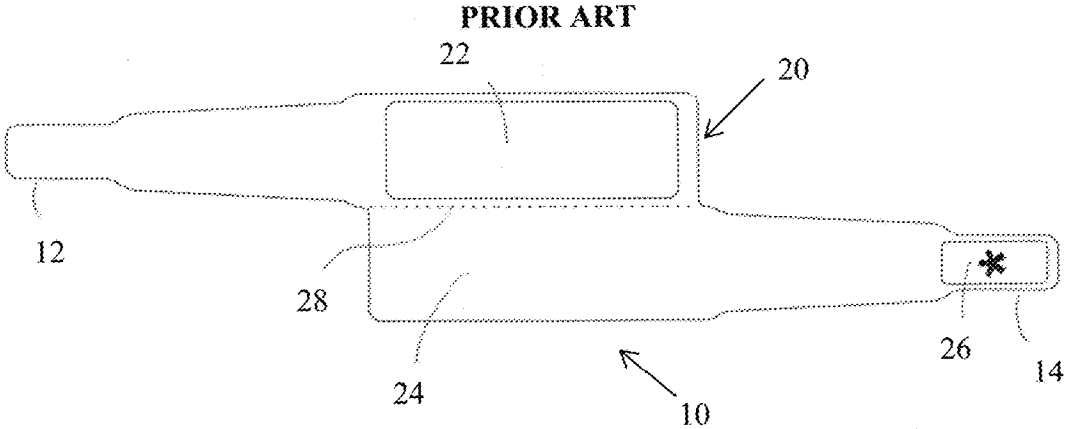
FIG. 1 is a top view of a form sheet, showing its face sheet side, of a prior art printable, laminating wristband.

Also, FIG. 7B reveals the continuous, smooth, skin-facing surface of the central body that may be attained by forming the identification band from the face sheet (as opposed to the prior art illustrated in FIG. 1). However, in some embodiments, it may be desirable to allow for the liner sheet underneath the printable area of the central body to be released from the form sheet, as can be seen in FIG. 5A.

Form sheet, and contextual references to it, can be understood as a term of art in this field. Generally speaking, it comprises a face stock material (also referred to as a face sheet) and a release liner (also referred to as a carrier, backing layer, release sheet, and/or liner sheet). Coatings and adhesives may be employed on either or both of the face stock and the release liner to impart certain, desired characteristics to the articles formed from such form sheets. Additional layers may be positioned proximate to or integrated with portions of the face stock and/or liner. Generally speaking, the form sheet is usually provided as a standard sized, rectangular sheet (e.g., A4 sized or U.S. letter sized, i.e., 8.5 inches by 11 inches) that may be fed into conventional desktop printers.

Exemplary documents, all of which are incorporated by reference herein, describing materials and methods associated with form sheets, their components, and exemplary articles formed therefrom can be found, inter alia, in United States Patent Publications 2016/0229211 and 2016/0293061, International Patent Publication No. WO/2016/172676, and U.S. Pat. Nos. 7,309,731 and 7,566,495.

The form sheet, including the wristband, labels, and/or unused portion, may include an RFID chip or other thin film flexible electronics to monitor patient location, vital signs such as pulse, oxygen level, temperature, and the like. Such components typically facilitate in communicating patient information, medication needs, dispensing instructions and history, and the like. When present, these components comprise circuitry and/or a power supply (e.g., a thin printed battery) and may be integrated in the face stock, the liner, or an additional layer, as well as being formed between such layers.

A plurality of die cuts can be made in the form sheet to facilitate formation and removal of the shaped objects described herein. The die cut arrays can be die cut, laser cut or otherwise formed to extend through or substantially through the face layer at a plurality of spaced apart locations thereon. The specific dimensions of the die cut arrays can vary depending upon the characteristics of the material from which the face layer is formed. However, the die cut arrays should be formed to permit separation of the face sheet and liner without excessive manipulation or force and without tearing either the identification bands or adjacent areas of the face layer. In certain embodiments, each die cut is a continuous die cut around the complete perimeter of all bands, cards, and/or labels. The length of each die cut and the lengths of the ties between die cuts will vary in accordance with the characteristics of the material from which the face layer is formed. In other aspects, die cuts that define the shape of the band are only formed in the face layer, and are not formed in the liner layer so as to enable a "peel off" functionality (i.e., only the strip comprising face stock is removable), particularly if a tri-layer material were to be used.

Additionally or alternatively, perforations may be formed to facilitate the separation of portions of the face sheet (and, with respect to the laminating flap, the liner sheet) from itself. These perforations may be formed in a manner similar to the die cuts described above or by other known mechanical means. As one example, die cuts in only the face sheet may be used to allow for peel off functionality of the ends 112, 114 and the central body 122, while perforations and/or die cuts penetrating both the face sheet and laminating flap (except along the boundary formed by line 142) allow for the liner to be released with the "peel off" portions of the band.

The face sheet may be formed from a wide variety of materials. For example, from paper, a woven material, a non-woven material, or a spun material. The face sheet can also be formed from combinations of these materials, either integrated together or provided on separate sections of the sheet itself. The thickness of this layer can vary anywhere from 25 up to 200 micrometers. Various continuous or partial coatings can be provided on either or both sides of the face sheet, as noted below.

Woven materials may include polymeric materials, such as polyester or nylon. Woven materials and fabrics may be impregnated with compatible fillers, polyester, styrene, acrylic or other compatible organic-based material. Woven materials typically are made from fibers that are oriented generally parallel to one another and can be bonded together via chemical, mechanical, heat, and/or solvent treatment(s). Non-woven material can be, for example, polyethylene, polypropylene, polyethylene terephthalate, polyvinyl chloride, polyester, polylactic acid, cellulose, or mixtures thereof. Other materials include vinyl (PVC), polystyrene, latex impregnated paper, polyolefin, and biaxially oriented polypropylene (BOPP). Spun materials are non-woven materials that typically are made from polymeric fibers. The fibers are oriented in a seemingly random orientation to resemble cloth or fabric. The fibers can be bonded together via chemical, mechanical, heat, and/or solvent treatment(s).

The face sheet includes a top surface or face and an oppositely directed underside or rear face. The top surface of the face layer can be imprinted with patient-specific indicia at locations corresponding to the identification band(s), the labels, the optional identification card, and/or other components, as will be described in more detail below.

In certain aspects, the face sheet includes a variety of paper materials can be used on its top, with a laser imprintable paper being specifically contemplated. However, the subject matter includes other paper types having different characteristics and properties such as but not limited to papers adapted for use with laser, thermal, and ink jet printers. In addition, papers adapted for use with direct thermal or thermal transfer are also contemplated.

In certain applications, it may be desired to apply one or more top coats to the top or face surface of the face layer. For example, in certain versions, a thermal coating layer may be deposited, formed, or otherwise provided on the face layer to facilitate thermal printing. Thus, the thermal coating layer's material (also referred to as a direct thermally activatable material) is heat activatable. In general, the thermal coating layer comprises a low solids water, a solvent, or a solventless borne liquid that includes a stoichiometric mixture of dye, sensitizer, and developer components. Representative materials from which the thermal coating layer can be made, include but are not limited to the following: NuCoat 8957 and 8952, which are provided by NuCoat of Plymouth, Minn. Representative waterborne versions of the thermal coating layer material include about 30-50% solids. Representative embodiments of the thermal coating layer material can include a leuco dye, a sensitizer, and a developer, which are intermixed and applied as a single coating to the substrate layer material.

Because the chemistry of the thermal coating layer's material typically is vulnerable to attack by alcohols, solvents, water, and/or other contaminants, a protective barrier coat, e.g., a topcoat layer, typically is applied over the thermal coating layer to protect the thermal coating layer. The topcoat layer includes a material that is resistant to abrasion and chemical or other environmental contaminants, e.g., organic contaminants, inorganic contaminants, and biological fluids. Accordingly, the topcoat layer is a protective layer that prevents damage to, or contamination of, the thermal coating layer. The topcoat layer can include organic water, solvent, or solventless liquid(s), for example, solvent-borne acrylics or silicones that can be dried or cured to develop its properties. Also, the topcoat layer can be UV curable. Examples of topcoat layer materials include the following: varnishes and other topcoat layer material provided by companies including Acetega of Wesel, Germany, the Flint Group of Plymouth, Mich., and Ashland Inc. of Covington, Ky., for example, Acetega 814HSMW2 and Flint UVF02052. In certain embodiments, the topcoat layer is applied with a coat weight in the range between about 5 grams per square meter and about 20 grams per square meter.

In addition to providing resistance to contaminants, the topcoat coating layer also can be print-receptive to ink(s) and other medium. If the topcoat coating layer is not receptive to ink(s) or other medium, and such receptiveness is desired, an additional coating layer can be applied over the topcoat layer, such that the additional coating layer is coupled to the topcoat layer, to impart the desired properties. The additional coating layer has a thickness which can range in value from about 0.05 mils to about 0.25 mils. Thus, the overall thickness of representative embodiments of the face layer that include the additional coating layer with the substrate layer, the thermal coating layer, and the topcoat layer can range in value from about 3.3 mils to about 6.4 mils. The additional coating layer can be made from UV, or 100% solids, or solvent-borne acrylics or silicones, and contain materials having abrasion-resistant properties, or other additives, depending on what finished performance properties are desired. An example of the material that can be used in the additional coating layer is varnish.

Insofar as the face sheet includes the laminating flap, at least this portion of the form sheet contemplates a third layer. That is, when the strip is removed from the liner, the laminating flap will still comprise a removable cutout (unless the lamination step is accomplished while the strip is retained within the form sheet). The flap itself is a thin, sufficiently transparent material with pressure sensitive adhesive applied to its top face (i.e., under the protective cutout), relying upon any of the appropriate materials described elsewhere herein. Once the cutout is removed, the flap is folded over the printed area to effectively laminate the printed material covered by it.

The liner layer is sized and shaped to correspond to the face layer and generally positioned along the face layer such that the top surface of the liner is directed toward the back surface or underside of the face layer. The liner layer can be made from any flexible paper or film, including fibrous and/or paper materials and other sheets/films with surface roughness suitable for feeding through a sheet fed printer. Most roll fed printers use a super calendered (SCK) paper or film liner.

Understanding that many available printers can process sheets with a total thickness of about 400 micrometers or less, the liner layer may have a thickness of anywhere from 25 to 200 micrometers, in order to provide sufficient support for the form sheet while still permitting efficient processing through a conventional printing apparatus. The thickness of the liner will ultimately depend upon the combined thickness of the face stock, the liner, and any intervening layers that may be required (including but not limited to the adhesives and other coatings that may be selectively applied to/within the layers of the overall form sheet).

The liner layer has a top surface, and an oppositely directed bottom or rear surface. As described in greater detail herein, a release coating is applied to one or more areas of the top surface of the liner layer that will register with the labels and one or more regions of the bands. Additional details of the release coating are provided herein.

The back surface or underside of the face layer can be registered with, and secured to, the top surface of the liner layer to form the sheet article. The sheet or rolled article then can be processed through a printer, such as a laser printer, thermal, or inkjet printer to print patient specific indicia on at least the identification panel of each identification band, on one or more labels, and on the optional identification card. Patient specific indicia also can be printed on other portions of the top surface of the face layer. As noted above, a combination format may be used, so that an identification band may be created simultaneously along with additional, separate label(s) that would be used in conjunction with the band (e.g., to affix to charts, medication or specimen bottles, and the like).

A variety of release coatings can be used. These coatings typically include a release coating or layer of a release agent between the layer of adhesive and an adjacent layer such as the liner layer. Generally, the release agent or composition containing such is in the form of a continuous layer, although discontinuous and/or pattern coatings can be leveraged to allow for portions of the face sheet and liner to become selectively separated more easily or quickly in comparison to others. In certain aspects, the release coating is a silicone material and more particularly, a UV cured silicone with an internally formulated release level deemed suitable for the application. Suitable suppliers include Momentive, Bluestar, Wacker, and Evonik. Other release compositions, such as fluorinated or amine based release compositions can be used. The release coating can be relatively thin, e.g., in the range of about 2.5 to 15 micrometers.

The release agent is typically applied in a liquid form and then cured. UV curable release agents are suitable for many embodiments. UV curing release systems are generally either cationic or free radical systems. Thermally cured release agents can also be used.

The various embodiment sheets typically include a layer of one or more adhesives between the face layer and the liner layer. Generally, the adhesive is a continuous layer in the region of the labels defined in the face layer, although it may be discontinuous and/or pattern coated in certain regions. Pressure sensitive adhesives may be preferred according to certain aspects, and water based pressure sensitive adhesives are also suitable for many embodiments. The thickness of any adhesive layers or portions/patches should be between 5 and 50 micrometers.

The adhesive should have a composition that will remain stable and not flow or substantially not flow when subjected to temperatures approaching or even exceeding 200° C. These characteristics facilitate printing of the sheet assembly article in a laser printer or other high temperature printing apparatus. The adhesive also should not degrade easily when exposed to ultra-violet (UV) light. In this regard, exposure to ultra-violet light during normal use of the components of the sheet assembly should not turn the adhesive yellow or cause the adhesive to lose its tackiness. One such adhesive is described in U.S. Pat. No. 5,262,216 to Popat et al., which is incorporated by reference. A hot melt adhesive is available from Avery Dennison Corporation under the designation P32™.

In certain versions of the present subject matter, an adhesive deadener or more particularly, a coating of a deadener material can be incorporated in certain regions of the sheet articles. One or more deadener agents can be provided along a region or face of an adhesive layer to reduce or eliminate the tackiness of the adhesive. Deadener can be applied to a previously formed region or layer of release agent that is disposed along an adhesive layer. Instead of applying the deadener agent(s) to a previously deposited release face, it is also contemplated that the deadener(s) could be incorporated within the release agent material prior to its deposition. Alternatively or in addition, the deadener(s) could also be utilized in conjunction with adhesive materials as described in greater detail herein. A variety of adhesive deadeners are known in the art such as for example, the deadeners disclosed in U.S. Pat. Nos. 5,982,284; 7,575,791; and 7,579,059.

In certain versions of the present subject matter, the release material and the deadener material are used together or in conjunction with one another. The silicone or other release agent is applied first to desired regions of the underside of the face layer, and then any area that is to exhibit reduced or no tack is coated with deadener over the silicone. For example, deadener is applied on silicone on the underside of the face layer in the strap region of a band. A permanent adhesive is coated on a corresponding region of the liner layer and then the two layers are laminated together. Upon end user removal of the band, the deadener transfers from the silicone due to adhesion between the deadener and the permanent adhesive. In particular embodiments, both the deadener and the silicone are UV cured coatings.

Alternatively, a deadener may be applied directly over the adhesive in certain locations while still releasably bonding the face and liner materials in a desired area of the form. Dry peel adhesives and/or releasable pressure sensitive adhesive may also be employed.

Instead of release agents and/or deadeners, a temporary adhesive exhibiting relatively low levels of tack or no tack, upon separation of the layers, could potentially be used. Additionally or alternatively, dry peel coatings may be used in place of the deadened pressure sensitive adhesives described herein.

As previously described, the various embodiment sheets may include one or more identification articles such as identification bands. The identification bands are typically attached to wrists and/or ankles of a patient in a hospital or healthcare environment. Indicia printed on the band can serve to identify the patient. Indicia printed on the band may also include information about the patient or the patient's care, medication(s), medical history, preferences, allergies, therapy, or other conditions or characteristics. It will be appreciated that the present subject matter includes a wide range of uses and applications of the identification bands.

Identification bands as described herein are particularly well suited for patients in a health care setting. Narrow width bands are especially well suited for the small wrists or ankles of infants. The band is sufficiently wide to provide the necessary strength and to prevent biting into the wrist or ankle of the patient. Additionally, the band in certain embodiments is wide enough to prevent twisting during normal use. In certain embodiments, the strip may have a width of from 0.5 to 5 centimeters in wide and a length of 10 to 30 centimeters.

One aspect of the various embodiments described herein is the ability to print the identification band efficiently and reliably in a laser printer, thermal, an inkjet printer or other commercially available printing apparatus. Printers work best when the printed sheets are relatively thin and have uniform thickness or coplanarity across the length and width of the sheet. Sheets that are too thick may not feed well in many machines and sheets that do not exhibit coplanarity across the sheet are likely to jam or otherwise become lodged in the feed mechanisms of the printer.

Further, the form sheets described herein focus only on sheets containing one or more bands. However, it may be possible to incorporate a band or a series of bands on a form sheet having chart labels formed on that form sheet, possibly enabling the user to print customized information on labels for additional uses that coincide with the wristband. In the same manner, other known technologies (e.g., radio frequency identification tags; temperature reactive coatings;

thin film, printed batteries; intelligent polymers; etc.) might be incorporated on the sheet. These technologies can be provided within the form sheet itself, so that the aforementioned technologies would be integrated onto the band. Additionally or alternatively, these technologies could be provided on a label that is provided on or appended to the form sheet containing the wristband.

Finally, while the description focuses on form sheets, it will be understood that the layered structure of such sheets may be provided in a rolled form. That is, rather than providing the articles in a single sheet, a plurality of bands could be formed on a continuous roll, with die cuts or perforations allowing the user to easily detach a band (or combination band/label) after it has been printed from the roll form. In this manner, direct thermal printers are amenable to the concepts described herein. Additionally or alternatively, inkjet printable coatings and thermal coatings may be applied to the sheets and rolls to accomplish these, and other, objects.

Although the present embodiments have been illustrated in the accompanying drawings and described in the foregoing detailed description, it is to be understood that the invention is not to be limited to just the embodiments disclosed, and numerous rearrangements, modifications and substitutions are also contemplated. The exemplary embodiment has been described with reference to the preferred embodiments, but further modifications and alterations encompass the preceding detailed description. These modifications and alterations also fall within the scope of the appended claims or the equivalents thereof.

What is claimed is:

1. A sheeted article providing at least one identification band comprising:

(a) a face layer having an upper surface and a lower surface and defining at least one identification band, the at least one identification band having:
- a first region proximate a first end,
- a second region defined by a second end,
- a print region defined between the first and second region and defining a top edge and a bottom edge, and
- a strap extending between the first and second end;

(b) a liner layer;

(c) a laminating member defined in the liner layer, the laminating member comprising a clear lamination flap proximate to the bottom edge of the print region, the flap comprising an upper surface and a lower surface, the upper surface of the flap having an adhesive disposed thereon, where the flap is detachable from the liner and foldable such that the upper surface of the flap contacts the upper surface of the identification band to cover at least a portion of the print region, wherein the laminating member comprises a section of the liner underlying the lower surface of the print region, and the laminating member is detachable from the sheeted article when the identification band is removed from the article.

2. The sheeted article of claim 1 wherein the lower surface of the identification band in the print region is bonded to the liner layer.

3. The sheeted article of claim 1 wherein the face layer comprises a release layer overlying the upper surface of the laminating flap, the release layer removable from the laminating flap to expose the adhesive.

4. The sheeted article of claim 1 further comprising:
- a release material disposed on the liner layer in an area corresponding to the first region of the band;
- a first adhesive overlying the release material;
- a second adhesive disposed on the liner extending along at least a majority in an area corresponding to the second region of the band; and
- a deadener disposed on the second adhesive; wherein upon removal of the identification band from the sheeted article, the first region of the identification band comprises the first adhesive.

5. The sheeted article of claim 1 wherein the face layer and the liner layer comprise a combination form sheet.

6. The sheeted article of claim 5 wherein the combination form sheet includes at least one of a label and an extender.

7. The sheeted article of claim 1 wherein the print region does not include any adhesive disposed on either the upper surface or the lower surface when the flap is attached to the liner.

8. The sheeted article of claim 1, wherein a dry peel adhesive, a releasable pressure sensitive adhesive or a combination of adhesives is disposed on at least a portion of the lower surface of the face layer within one or more of the first region, the first end, the second region, the second end, and the strap.

9. The sheeted article of claim 1 wherein a plurality of identification bands are provided.

* * * * *